US008973367B2

(12) United States Patent
Böttcher et al.

(10) Patent No.: US 8,973,367 B2
(45) Date of Patent: Mar. 10, 2015

(54) FUEL LANCE FOR A BURNER

(75) Inventors: Andreas Böttcher, Mettmann (DE); Tobias Krieger, Duisburg (DE); Jürgen Meisl, Mülheim an der Ruhr (DE)

(73) Assignee: Siemens Aktiengesellschaft, München (DE)

( * ) Notice: Subject to any disclaimer, the term of this patent is extended or adjusted under 35 U.S.C. 154(b) by 813 days.

(21) Appl. No.: 13/133,741

(22) PCT Filed: Nov. 5, 2009

(86) PCT No.: PCT/EP2009/064664

§ 371 (c)(1),
(2), (4) Date: Jun. 9, 2011

(87) PCT Pub. No.: WO2010/066516

PCT Pub. Date: Jun. 17, 2010

(65) Prior Publication Data

US 2011/0247338 A1 Oct. 13, 2011

(30) Foreign Application Priority Data

Dec. 12, 2008 (EP) ..... 08171548

(51) Int. Cl.

| | |
|---|---|
| ***F02C 1/00*** | (2006.01) |
| ***F02G 3/00*** | (2006.01) |
| ***F23R 3/28*** | (2006.01) |
| ***F23D 11/12*** | (2006.01) |
| ***F23D 11/38*** | (2006.01) |

(52) U.S. Cl.

CPC ..... *F23R 3/283* (2013.01); *F23D 11/12* (2013.01); *F23D 11/38* (2013.01); *F23D 2214/00* (2013.01)

USPC ..... 60/742; 60/740

(58) Field of Classification Search

USPC ..... 60/39.83, 737, 740, 742; 239/132, 239/132.1, 132.3, 132.5, 398, 399, 400, 239/433; 431/8, 187, 354

See application file for complete search history.

(56) References Cited

U.S. PATENT DOCUMENTS

| | | | | |
|---|---|---|---|---|
| 3,349,826 | A | 10/1967 | Poole | |
| 4,070,826 | A * | 1/1978 | Stenger et al. | 60/748 |
| 4,198,815 | A * | 4/1980 | Bobo et al. | 60/737 |
| 5,222,357 | A * | 6/1993 | Eddy et al. | 60/800 |
| 7,325,402 | B2 | 2/2008 | Boonsuan | |
| 7,762,070 | B2 * | 7/2010 | Dawson et al. | 60/740 |
| 2001/0042798 | A1 | 11/2001 | Gulati et al. | |
| 2002/0073708 | A1 | 6/2002 | Lavie et al. | |
| 2002/0073710 | A1 * | 6/2002 | Bechtel et al. | 60/740 |
| 2006/0027232 | A1 * | 2/2006 | Parker et al. | 126/349 |

FOREIGN PATENT DOCUMENTS

| | | | |
|---|---|---|---|
| EP | 0552477 | A1 | 7/1993 |
| EP | 1760403 | A2 | 3/2007 |
| JP | 52079112 | A | 7/1977 |
| JP | 61181924 | U | 11/1986 |
| JP | 5248638 | A | 9/1993 |
| JP | 2002340307 | A | 11/2002 |

(Continued)

*Primary Examiner* — Gerald L Sung
*Assistant Examiner* — Scott Walthour

(57) ABSTRACT

Disclosed is a fuel lance for a burner, in particular a gas turbine burner, including a tip that has a nozzle surface including at least two fuel nozzles. The nozzle surface is provided with slots between the fuel nozzles. As a rule, the lance is provided for operation with a liquid fuel.

6 Claims, 2 Drawing Sheets

(56) References Cited

FOREIGN PATENT DOCUMENTS

| | | | |
|---|---|---|---|
| JP | 2003524138 | A | 8/2003 |
| JP | 2003247425 | A | 9/2003 |
| JP | 2004144379 | A | 5/2004 |
| RU | 12218 | U1 | 12/1999 |
| RU | 723867 | A1 | 11/2005 |
| TW | 501947 | B | 9/2002 |
| WO | WO 0156703 | A1 | 8/2001 |

* cited by examiner

FUEL LANCE FOR A BURNER

CROSS REFERENCE TO RELATED APPLICATIONS

This application is the US National Stage of International Application No. PCT/EP2009/064664, filed Nov. 5, 2009 and claims the benefit thereof. The International Application claims the benefits of European Patent Office application No. 08171548.4 EP filed Dec. 12, 2008. All of the applications are incorporated by reference herein in their entirety.

FIELD OF INVENTION

The present invention relates to a burner lance, for example for a gas turbine burner, and in particular a fuel lance for liquid fuels.

BACKGROUND OF INVENTION

Fuel lances of this kind are used for example in burners which can be operated both with liquid fuel and also with gaseous fuel. As a rule, the lance is provided for operation with the liquid fuel, for example oil. The oil then flows through the lance and emerges at its tip through oil nozzles into a combustion chamber. After egress from the nozzle the oil is burned in the combustion chamber, into which compressor air is also introduced. Gaseous fuels on the other hand are frequently injected into an air feed channel surrounding the nozzle lance, and there mixed with compressor air, before the mixture is introduced into the combustion chamber.

In the case of operation with gaseous fuels, the lance tip is as a rule subject to high temperatures in the area of up to approx. 1000° C. as a result of the proximity of the flame. These high temperatures can lead to a carbonization of residues of liquid fuel in the nozzle lance. Accordingly, before switching the burner to operation with a liquid fuel a scavenging of the fuel passages in the fuel lance with cooling water generally takes place, in order to flush away possible deposits. The temperature of the cooling water however stands at only approx. 25° C., which can lead to a thermal shock in the hot fuel lance. High temperature gradients thereby arise in the area of the nozzles, so that considerable thermal stresses can occur in the lance tip. Through the repeated occurrence of such thermal stresses, splits in the area of the nozzles may ensue, whereby the start values and thus the useful life of the fuel nozzle are reduced.

US 2001/0042798 A1 discloses a fuel lance with a tip, having a nozzle surface with two fuel nozzles, where the nozzle surface between the fuel nozzles is provided with slots.

US 2006/0027232 A1 discloses a fuel lance with slots.

EP 1760403 A2 discloses fuel nozzles for gas turbines.

SUMMARY OF INVENTION

It is the object of the present invention to make available a fuel lance for use in a burner, in particular in a gas turbine burner, which helps to overcome the disadvantages cited. It is a further object of the invention to provide an advantageous combustion apparatus, in particular a gas turbine burner.

The first object is achieved by a fuel lance for a burner, in particular for a gas turbine burner, as claimed in the claims, the second object by a burner, in particular a gas turbine burner as claimed in the claims. The dependent claims contain advantageous embodiments of the invention.

A fuel lance for a burner, in particular for a gas turbine burner, comprises a tip, having a nozzle surface with at least two fuel nozzles. The nozzle surface is provided with slots between the fuel nozzles. It can in particular be embodied as an annular surface, possibly as a conical annular surface, where the slots run perpendicular to the circumference of the annular surface and through the annular surface.

The slots in the nozzle surface allow the lance tip to reduce thermal stresses by means of free deformation, so that thermal gradients impose less stress on the fuel lance. The slots have no significant aerodynamic influence on the air flowing along the fuel lance or on fuel which is injected through the fuel nozzles into the stream of air. The slots also mean only a minor modification of the fuel lance, which can additionally be performed with very little effort. Accordingly, existing fuel lances can be upgraded with little effort, whereby the possible start values and the useful life of this fuel lance are increased.

Cooling air channels can be present in the tip, which run between the fuel nozzles below the nozzle surface. For example by means of compressor air directed through the cooling fluid channels, the tip of the fuel lance can be cooled during the operation of the burner, in order to keep the temperature of the tip as low as possible, and thus further to minimize the incidence of thermal stresses during the scavenging of the fuel lance. The slots then ideally extend from the nozzle surface as far as the respective cooling fluid channel. In other words the slots form through-openings from the nozzle surface to the cooling fluid channel. This embodiment permits a particularly high degree of flexibility of the corresponding material areas for the reduction of thermal stresses.

If the annular surface is a conical annular surface, the tip of the fuel lance can have the form of a truncated cone. In this case the girthed area of the truncated cone forms the nozzle surface, and the cooling fluid channels have outlet openings which are open at least towards the covering surface of the truncated cone. Alternatively or in addition to the aforementioned outlet openings, through-openings can be present around the fuel nozzles, which are fluidically connected to the air feed channels. Compressor air exiting through these openings can then be used to cool the tip of the lance in particular in the area of the nozzles to be scavenged. Given the presence of such through-openings a slot can in each case be arranged in particular between the fuel nozzles adjacent to the through-openings.

An inventive burner, which can in particular be a gas turbine burner, is equipped with an inventive fuel lance. The fuel lance can here be used for the supplying of a liquid fuel, where in addition to the fuel lance, fuel nozzles for gaseous fuels can also be present.

The use of the inventive fuel lance in the inventive burner means, because of the increased useful life of the fuel lance, that the maintenance intervals for such a burner can be extended, which cuts operating costs.

BRIEF DESCRIPTION OF THE DRAWINGS

Further features, properties and advantageous of the present invention are evident from the following description of an exemplary embodiment, with reference to the attached figures.

DETAILED DESCRIPTION OF INVENTION

Figure 1:
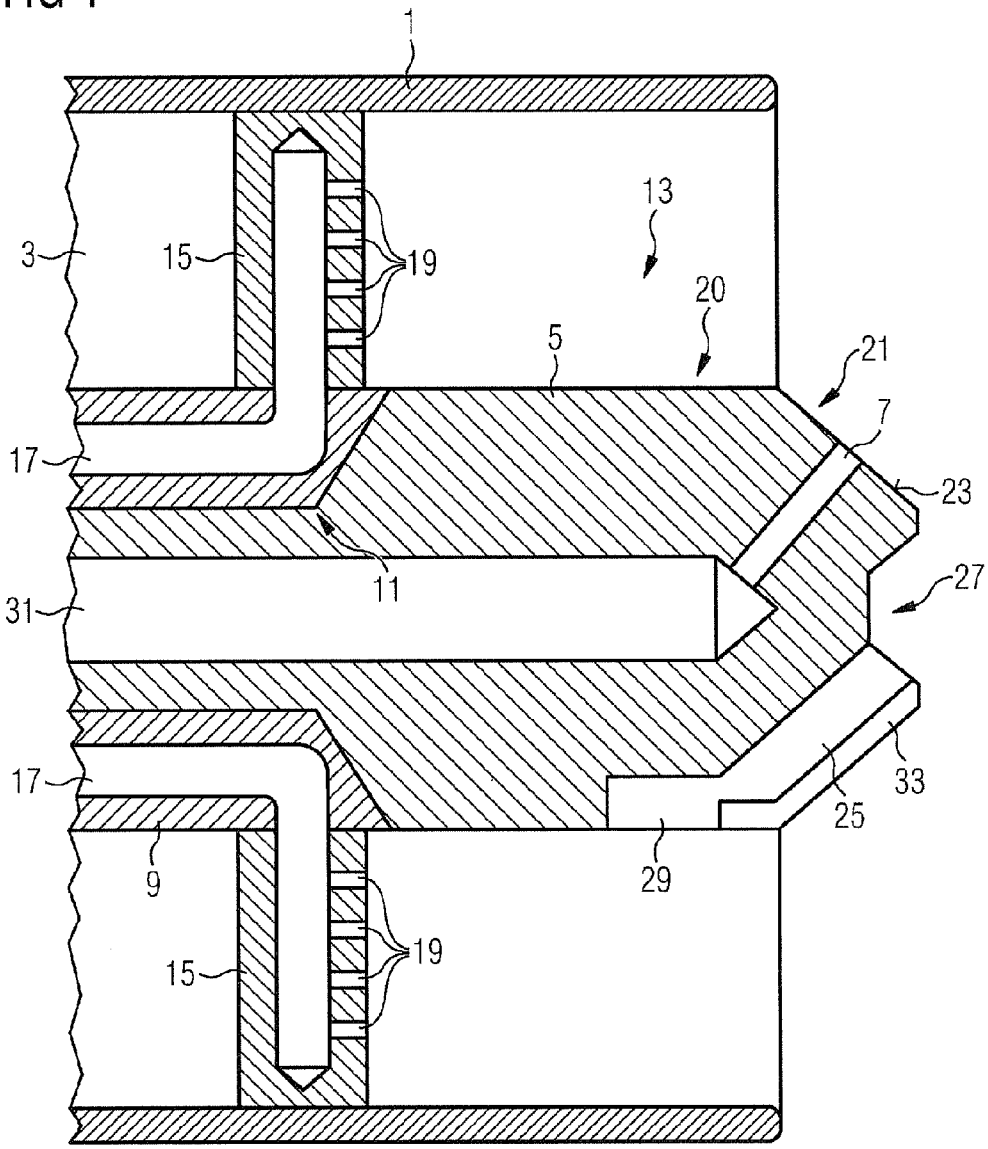
FIG. 1 shows an inventive burner in a cutaway representation.

A gas turbine burner is represented as an exemplary embodiment for an inventive burner in FIG. 1. This has an air feed channel 3 delimited by an essentially cylindrical wall 1, in the center of which runs a fuel lance 5. At the tip of the fuel lance are fuel nozzles 7 for the injection of a fuel into the air conducted through the air feed channel 3. In the present exemplary embodiment the fuel lance 5 is an oil lance for the supplying of a liquid fuel.

In addition to the fuel lance, the burner comprises a second fuel feed system 9, which has an axial duct 11, through which the fuel lance 5 is directed, so that only the end section 13 of the fuel lance 5 protrudes from the fuel feed system 9. The fuel feed system 9 is connected to swirl blades 15, which are located at the downstream end of the fuel feed system 9 and extend through the air feed channel 3. By means of fuel feed channels 17, a fuel, in the present exemplary embodiment a gaseous fuel, is directed into the swirl blades 15, from which it is injected through nozzle openings 19 into the air flowing through the air feed channel 3.

The burner represented in FIG. 1 takes the form of a so-called "Dual Fuel burner", that is a burner which can be operated both with gaseous fuels, as with liquid fuels. The invention can however also be realized within the scope of burners in which a fuel can be fed in the same aggregate state in each case both through the fuel feed system and through the fuel lance, that is for example within the scope of a burner, in which a gaseous fuel is fed in each case both through the fuel feed system, as well as through the fuel lance. The fuel lance can then for example be employed as a pilot burner.

Figure 2:
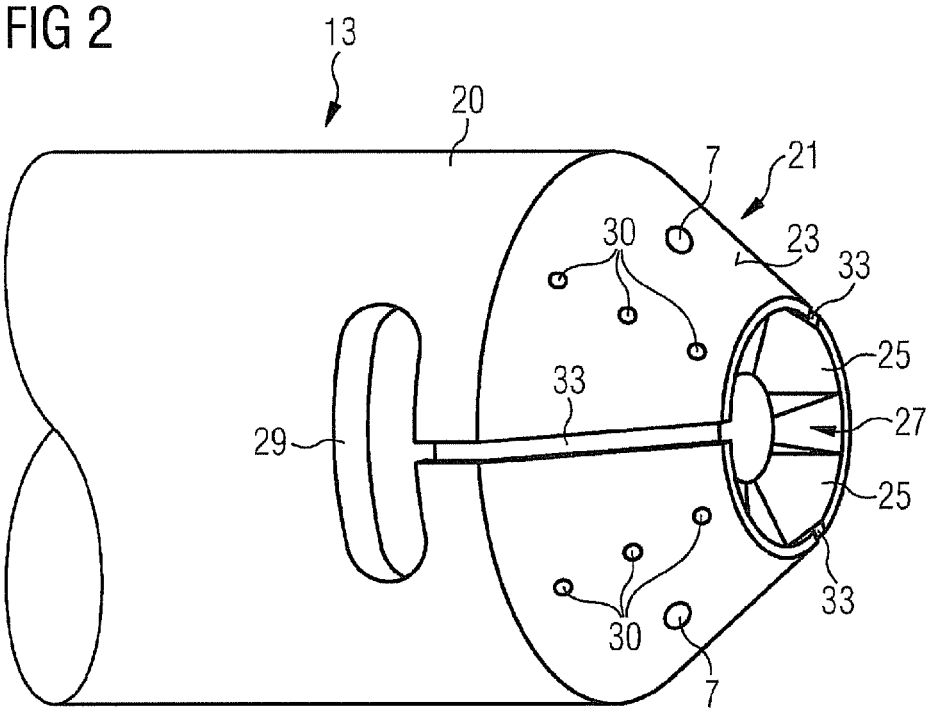
FIG. 2 shows the tip of the nozzle lance of the inventive burner in FIG. 1, in a perspective representation.
Figure 3:
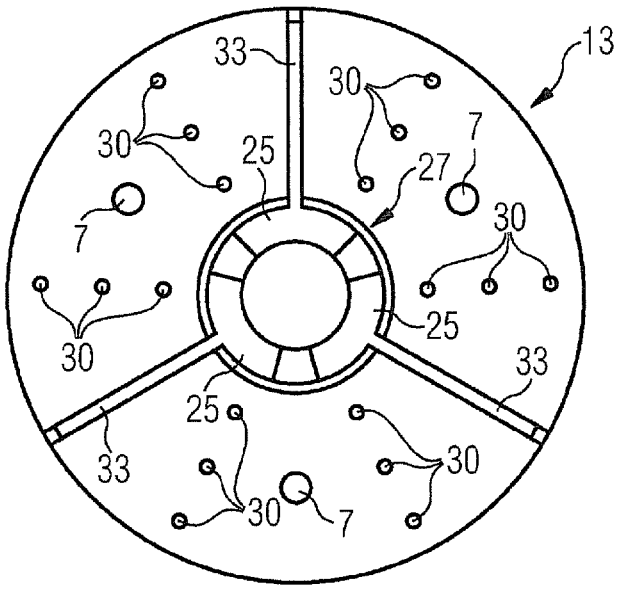
FIG. 3 shows the tip from FIG. 2 in a frontal view.

A perspective representation of the end section 13 of the fuel lance 5 is shown in FIG. 2. FIG. 3 additionally shows a frontal view of the end section along the axial direction of the fuel lance 5 in the direction of view.

The end section 13 will now be described in greater detail with reference to FIGS. 1 to 3. The end section 13 comprises an essentially cylindrical section 20, to which is attached an essentially truncated cone-shaped tip 21. In the girthed area 23 of the truncated cone-shaped tip 21 three fuel nozzles 7 are arranged evenly distributed in the circumferential direction, as can be seen in particular in FIG. 3. It should however be pointed out at this point that a tip with three fuel nozzles only represents one possible embodiment variant and that more or fewer fuel nozzles or a different distribution of the nozzles in the girthed area are possible.

For cooling of the tip 21, this is provided with cooling air channels 25, which lead into a central opening 27. These are located where the covering surface of the truncated cone runs. The cooling air channels 25 are supplied by feed openings 29 in the cylindrical section 20 of the end section 13 of the nozzle lance 5. Upon operation of the burner, part of the air flowing through the air feed channel 3 flows through the feed openings 29 into the cooling air channels 25. This air has temperatures which are cooler than the temperatures of the tip 21. Nevertheless in the case of gas-fired operation of the burner represented, the tip 21 is heated to temperatures of around 800 to 1000° C. by means of the flame prevailing in the flame chamber.

If a switch is to be performed from gas operation, in which the gaseous fuel is fed through the fuel feed system 9, to oil-fired operation, in which the fuel is supplied through the fuel lance, a scavenging of the fuel passage 31 and of the fuel nozzles 7 of the fuel lance 5 takes place, in order to avoid carbonizations. This scavenging is typically performed using water, which has a temperature of around 25° C. As a result of the great temperature difference between the scavenging water on the one hand and the tip 21 on the other hand, the tip is thereby subjected to thermal stresses, which are to be reduced in a defined manner. In order to enable the defined reduction of these thermal stresses, the girthed area 23 of the tip 21 forming the nozzle surface is provided with slots 33. In the present exemplary embodiment the slots 33 extend through the girthed area 23 to the cooling air channels 25, so that upon operation of the burner, cooling air can emerge through the slots 33, in order to block this against the entry of hot combustion gases.

In the present exemplary embodiment the slots 33 further extend as far as the feed openings 29. They can however also be arranged solely in the girthed area 23 of the truncated cone, so that no slot section runs through the cylindrical section 20.

In the present exemplary embodiment the slots 33 are in each case arranged in the center between two fuel nozzles 7. Depending on the fluidic conditions in the area of the tip (for example taking account of the swirl created by the swirl generators 15), the slots 33 can also however also be offset in a clockwise or counterclockwise in comparison to the exemplary embodiment represented in the figure. It is further possible to provide a multiplicity of slots, if these extend only through the girthed area 23 of the truncated cone 21, but not through the cylindrical section 20. The deformation of the truncated cone girthed area 23 in the area of the cooling air channels 25 made possible by the slots 33 then enables the reduction of the thermal stresses arising during the scavenging process.

In the present exemplary embodiment, through-openings 30 are optionally present around the fuel nozzles 7, which extend as far as the cooling air channels 25 and which enable the passage of cooling fluid. Hereby it is possible to achieve particularly effective cooling of the material of the lance tip in the area of the nozzle openings 7 to be scavenged, whereby the thermal shock is reduced upon scavenging, and thus the thermal stresses to be decreased are also reduced.

The provision of the slots 33 in the fuel lance of the inventive burners enables in an advantageous manner the reduction of thermal stresses during the scavenging of the fuel lance with scavenging water, without the slots negatively influencing the aerodynamics in the area of the tip of the fuel lance. As a result of the improved reduction of the thermal stresses, the useful life of the fuel lance is prolonged. The introduction of the slots into existing fuel lances without slots can in addition be realized without significant effort, so that existing fuel lances can be upgraded with little outlay.

The invention claimed is:

1. A fuel lance for a burner, comprising:

a tip including a nozzle surface, the nozzle surface including a plurality of fuel nozzles, wherein the nozzle surface also includes a plurality of slots between the fuel nozzles such that at least one slot of the plurality of slots is arranged between a pair of circumferentially adjacent fuel nozzles of said plurality of fuel nozzles, wherein the nozzle surface is a conical annular surface and the plurality of slots run perpendicular to a circumferential direction of the conical annular surface from a first end to a second end of the conical annular surface, and extend through the conical annular surface to a respective one of a plurality of cooling air channels disposed in the tip, wherein each respective one of the plurality of cooling air channels is positioned radially inward of the nozzle surface and between a respective pair of circumferentially adjacent fuel nozzles, and wherein a plurality of through-openings are disposed between each pair of circumferentially adjacent fuel nozzle and slot on the nozzle surface, the through-openings between a respective pair of circumferentially adjacent fuel nozzle and slot being fluidically connected to a respective one of the plurality of cooling air channels.

2. The fuel lance as claimed in claim 1, wherein the fuel lance is used in a burner for a gas turbine.

3. The fuel lance as claimed in claim 1, wherein the tip is in the form of a truncated cone and a girthed area of the truncated cone is the nozzle surface.

4. A burner, comprising:

a fuel lance, comprising:

a tip including a nozzle surface, the nozzle surface including a plurality of first fuel nozzles, wherein the nozzle surface also includes a plurality of slots between the first fuel nozzles such that at least one slot of the plurality of slots is arranged between a pair of circumferentially adjacent first fuel nozzles of said plurality of first fuel nozzles, and wherein the nozzle surface is a conical annular surface and the plurality of slots run perpendicular to a circumferential direction of the conical annular surface from a first end to a second end of the conical annular surface, and extend through the conical annular surface to a respective one of a plurality of cooling air channels disposed in the tip, wherein each respective one of the plurality of cooling air channels is positioned radially inward of the nozzle surface and between a respective pair of circumferentially adjacent fuel nozzles, and wherein a plurality of through-openings are disposed between each pair of circumferentially adjacent fuel nozzle and slot on the nozzle surface, the through-openings between a respective pair of circumferentially adjacent fuel nozzle and slot being fluidically connected to a respective one of the plurality of cooling air channels.

5. The burner as claimed in claim 4, wherein the fuel lance is used for the supplying of a liquid fuel, and wherein the burner further comprises a plurality of second fuel nozzles for gaseous fuels.

6. The burner as claimed in claim 4, wherein the burner is a gas turbine burner.

* * * * *